United States Patent [19]

Collins

[11] Patent Number: 4,500,154

[45] Date of Patent: Feb. 19, 1985

[54] ELECTRICAL CONNECTOR ASSEMBLY HAVING AN ANTI-DECOUPLING DEVICE

[75] Inventor: Gordon T. Collins, Franklin, Ind.

[73] Assignee: Allied Corporation, Morristown, N.J.

[21] Appl. No.: 480,191

[22] Filed: Mar. 30, 1983

[51] Int. Cl.[3] ..... H01R 13/623

[52] U.S. Cl. ..... 339/89 M; 339/DIG. 2

[58] Field of Search ..... 339/89 R, 89 C, 89 M, 339/90 R, 90 C, DIG. 2; 285/82, 87, 88, 92

[56] References Cited

U.S. PATENT DOCUMENTS

| | | | |
|---|---|---|---|
| 917,204 | 4/1909 | Walther | 285/88 |
| 2,728,895 | 12/1955 | Quackenbush | 339/89 |
| 2,784,385 | 3/1957 | Ennis | 339/89 M |
| 2,890,434 | 6/1959 | Ray et al. | 339/89 R |
| 4,059,324 | 11/1977 | Snyder et al. | 339/89 M |
| 4,208,082 | 6/1980 | Davies et al. | 339/DIG. 2 |
| 4,285,564 | 8/1981 | Spinner | 339/89 C |
| 4,389,081 | 6/1983 | Gallusser et al. | 339/89 M |

FOREIGN PATENT DOCUMENTS 2136500 2/1979 Fed. Rep. of Germany .... 339/89 R

*Primary Examiner*—John McQuade

*Attorney, Agent, or Firm*—C. D. Lacina

[57] ABSTRACT

A latch member (46) pivotally disposed externally of a coupling nut (40) rotatably mounted on one shell (10) for threadably connecting to another shell (20), the latch member and having an end portion (50) thereof extending forwardly of the coupling nut, mating tapered surfaces (55, 30) formed on an inner face (55) of the latch member and annularly around the other shell and longitudinally and radially extending splines (39, 59) disposed around the mating tapered surfaces and configured to slidably interengage to prevent and/or resist uncoupling rotation, the latch member (46) pivoting and biasing the splines into engagement and being adapted to provide a manual release mechanism to laterally disengage the splines. The splines are so positioned by the latch member as to be normally out of engagement until full mating of the shells is achieved assembly.

9 Claims, 7 Drawing Figures

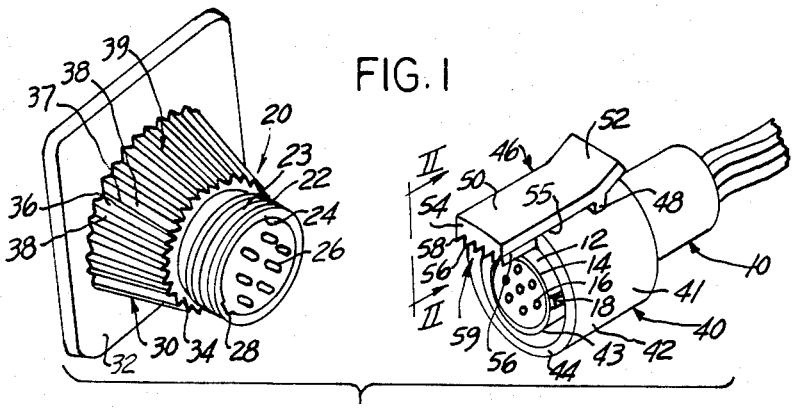
FIG. 1
FIG. 2
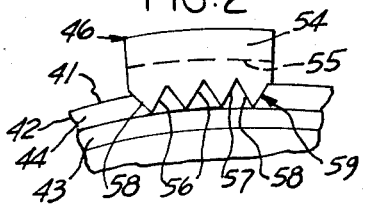
FIG. 7
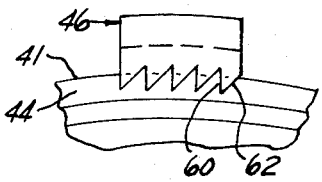
FIG. 6
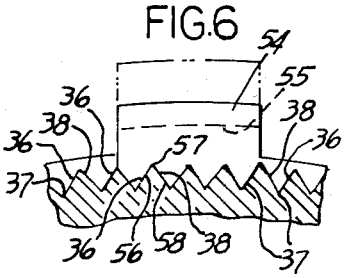
FIG. 3
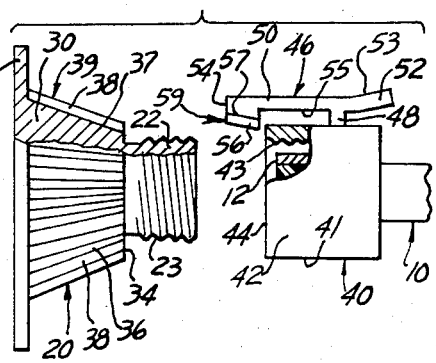
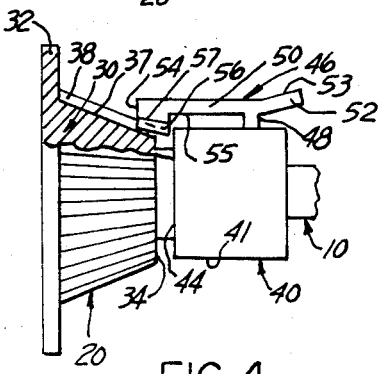
FIG. 4
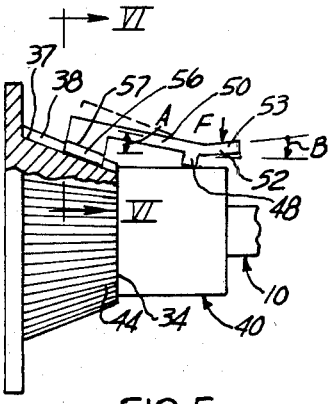
FIG. 5

ELECTRICAL CONNECTOR ASSEMBLY HAVING AN ANTI-DECOUPLING DEVICE

This invention relates to an electrical connector assembly having an anti-decoupling device including manually deflectable ratchet teeth.

It is common practice to employ a coupling nut to provide mechanical coupling between the ends of connector shells to maintain mating contact between electrical contacts mounted therein. Because coupling engagement is by sliding rotational movement between threads on the coupling nut and on one of the connector shells and because the coupling nut is held in place solely by friction therebetween, it is not uncommon to find that the coupling nut will tend to loosen and/or axially back-off under vibrational influences to which the connector bodies may be subjected. It would be desirable to have a coupling nut which would hold the connector members in place but yet which could be easily disengaged by the user. Means for resisting uncoupling and unwanted back-off of the coupling member from its connection have comprised a variety of separately provided and expensive spring members disposed cooperatively between the coupling nut and the connector shell to which it is rotatably mounted. While suitable in many applications, less expensive means for preventing unwanted back-off through elimination of separate parts would be desirable.

Accordingly, this invention provides an electrical connector assembly with an anti-decoupling device, the electrical connector assembly including a pair of mateable shells and a coupling nut mounted for rotation on one of the shells and adapted to connect to the other shell to draw the shells together in their mated relationship, the anti-decoupling device preventing unwanted rotation of the coupling nut relative to the shells and characterized by normally inoperative ratchet teeth on the coupling nut and on the other of the two shells engageable to become operative only when the connector shells approach their nearly fully mated condition by rotation of the coupling nut in a mating direction, the ratchet teeth providing a self-contained lock against unwanted contra-rotation of the coupling nut in the unmating direction. Manually activated release means are provided for permitting the locking action to be released at any point of tooth engagement and independently of the coupling nut rotation.

A particular embodiment in accord with this invention comprises the coupling nut being integrally formed from a plastic material and including a generally cylindrical coupling sleeve having a transverse forward end face, a deflectable latch member pivotally hinged to the sleeve and having its forward end portion thereof extending beyond the end face of the coupling sleeve, the other connector shell having an annular shoulder extending outwardly therefrom and therearound, a plurality of longitudinally extending an arcuately disposed ratchet teeth on an inner face of the latch member and a plurality of like formed and longitudinally extending ratchet teeth disposed around the annular shoulder of the other connector shell, the inner face and the annular shoulder forming tapered mating surfaces and the ratchet teeth provided thereon being configured to engage with one another when the shells are mated. The ratchet teeth have forward and rearward flank surfaces with the forward flank surfaces permitting coupling direction rotation and the rearward flank surfaces, preferably, preventing rearward uncoupling direction rotation. Initial axial advance of the one shell toward the other upon rotation of the coupling nut does not cause the ratchet teeth to engage. Further axial advance causes the ratchet teeth to engage and the forward end of the latch member to be slidably cammed radially upwardly and rearwardly into the ratchet teeth formed around the annular shoulder on the other connector shell. Further rotation of the coupling nut and the biased engagement by the latch member compressing the ratchet teeth more firmly together. Interim engagement between the coupling nut and the shells in a less than fully mated position is maintained by the ratchet teeth until a user continues coupling rotation or manually deflects the releasable latch member, coupling rotation driving the forward flank surfaces together whereby the latch member is driven upwardly and rotation continues, uncoupling rotation driving the rearward flank surfaces together to, preferably, prevent rotation.

An advantage of the coupling nut with integral latch (or latches) is elimination of separate spring members and/or additional pieces to resist uncoupling rotation. Another advantage of this invention is provision of a simple approach for retaining a coupling nut in its coupled relation with an electrical connector housing. Another advantage of the present invention is a self-contained locking coupling device utilizing ratchet teeth which during initial coupling do not engage but upon further coupling slidably engage and are manually releasable from any position of interengagement, thereby reducing unnecessary wear on teeth.

One way of carrying out the invention as described in detail below with reference to the drawings which illustrate one specific embodiment of this invention, in which:

FIG. 1 is a disconnected electrical connector assembly shown including a deflectable latch member on a coupling nut.

FIG. 2 is an end view of the latch member taken along lines II—II of FIG. 1 showing rachet teeth thereon.

FIG. 3 is a side view, partially in section, of the connector assembly of FIG. 1 positioned for mating.

FIG. 4 is a side-view, partially in section, of the electrical connector assembly of FIG. 3 shown partially interconnected.

FIG. 5 is a side view, partially in section, of the electrical connector assembly of FIG. 3 shown completely interconnected.

FIG. 6 is an end view of the latch member taken along lines VI—VI of FIG. 5 and interengagement of rachet teeth.

FIG. 7 is an end view of the latch member having an alternate ratchet tooth configuration.

Referring now to the drawings, FIG. 1 shows an electrical connector assembly including first and second connector shells 10, 20 and a coupling nut 40, first shell 10 having a generally cylindrical forward portion 12 having a transverse end face 14, second shell 20 having a generally cylindrical forward portion 22 having a transverse end face 24 and external thread 23 on an outside surface thereof and coupling 40 having a generally cylindrical forward portion 42 having an outer surface 41, a transverse end face 44 and internal thread 43 on its interior surface, forward portion 22 being sized to telescope about forward portion 12 and within forward portion 42 of coupling nut 40, the coupling nut being rotatably mounted to first shell 10 for connecting the shells 10, 20 together in mating relationship, rotation of coupling nut 40 causing thread 23, 43 to engage and shells 10, 20 to be drawn axially towards one another. Each shell 10, 20 typically includes an interengageable electrical contact 16, 26 of the socket and pin-type and the shells 10, 20 would be characterized as being plug and receptacle-type connectors. A key 18 on one connector shell 12 would be adapted to orient and align with a keyway 28 disposed in the other connector shell 22 to constrain shells 10, 20 for axial advance only while coupling nut 40 is rotated.

Preferably and in accord with this invention an anti-decoupling device cooperative between coupling nut 40 and second shell 20 prevents unwanted uncoupling disconnection between the shells 10, 20. Coupling nut 40 is comprised of a plastic material integrally molded into one-piece and includes a latch member 46 mounted by a support 48 to the outer surface 41 of forward portion 42 in radially spaced relation thereto, latch member 46 having forward and rearward end portions 50, 52 adapted to pivot about support 48 with forward end portion 50 thereof having an arcuate innerface 55 extended axially forward of end face 44 and adapted to deflect laterally relative to forward portion 42 of the coupling nut. Second shell 20 is shown as including a generally rectangular plate 32 for mounting the shell to a bulkhead (not shown) and an annular shoulder 30 having a transverse end face 34, the annular shoulder being disposed rearwardly of external thread 23.

Mating surfaces are formed, respectively, around annular shoulder 30 and on inner face 55 of latch member 46. Preferably the mating surfaces are tapered relative to the primary axis of the shells, coaxially disposed and frusto-conical in shape with each tapered surface being provided with a plurality of longitudinally extending and substantially equiangularly spaced splines 39, 59 (i.e. ratchet teeth) which are positioned to slidingly engage with one another upon nearly full mating, the splines having, respectively, first flank surfaces 36, 56, second flank surfaces 38, 58 and intermediate grooves 37, 57. The flank surfaces are acutely angled relative to a radius extending from the primary axis so as to cam the latch member upwardly and over the ratchet teeth formed on the annular shoulder to allow rotation upon application of an external torque to the coupling nut.

FIG. 2 shows an end view of latch member 46, inner face 55 and longitudinal splines 59. Each spline 59 is generally V-shaped in cross-section and each is defined by groove 57 and flank surfaces 56, 58, each flank surface being acutely angled relative to a radius extending from the primary axis with first flank surface 56 being disposed so as to face in the coupling direction and second flank surface 58 being disposed so as to face end the uncoupling direction, second flank surface 58 being more acutely angled than first flank surface 56 to thereby offer greater resistance to rotation when engaged with splines 39 formed on the frusto-conical surface of annular shoulder 30, the other splines 39 being like shaped.

FIG. 3 shows connector shells 10, 20 positioned for mating. Latch member 46 has its medial portion pivotably mounted by support 48 to coupling nut 40, its forward end portion 50 extending longitudinally forward of the coupling nut transverse end face 44 whereby splines 59 on inner face 55 thereof face radially inward and its rearward end portion 52 extending longitudinally rearward, rearward end portion 52 having an outer surface 53 facing outwardly and positioned to receive a radially inward force, application of force thereagainst causing forward end portion 50 to pivot upwardly to allow manual release of the splines 39, 59, the latch member being substantially parallel to outer surface 41 of coupling nut 40 and the primary axis of the connector shells.

FIG. 4 shows partial telescoping engagement of cylindrical forward portions 12, 22, 42 and threaded engagement between first shell 10 and coupling nut 40 wherein partial mating of the contacts is achieved. This interim engagement does not cause splines 39, 59 (i.e. ratchet teeth) to engage and the splines have been inoperative to resist coupling/uncoupling rotation. Further coupling rotation advances the splines into engagement and frusto-conical shoulder 30 to engage latch member 46, the splines when engaged allowing rotation of the coupling nut.

FIG. 5 shows end face 44 of coupling nut 40 abutting end face 34 of connector shell 20, latch member 46 pivoted relative to support 48 and inner face 55 deflected radially upward relative to outer surface 41 of the coupling nut and the splines 59 fully engaged with the splines 39 on connector shell 20. The letter "A" indicates the upward angular deflection of latch member 46. In this deflected position the latch member biases the ratchet teeth 39, 59 together.

For release, a user would apply a radially inward force, shown by the letter "F", against outer surface 53 of rearward end portion 52 causing the forward end 50 of latch member 46 to pivot upwardly and the ratchet teeth to be disengaged such as shown by the dotted lines and angle "B".

FIG. 6 shows the engagement between the splines (i.e. ratchet teeth) 39, 59 and respective first and second flank surfaces 36, 56 and 38, 58 respectively engaging. The dotted lines show the deflected position of forward end portion 50.

FIG. 7 shows an alternate configuration for the spline-ratchet teeth wherein first flank surfaces 62 are disposed at on acute angle and second flank surfaces 60 are radially extending, the first flank surfaces 62 defining a cam to allow rotation in the coupling direction and the second flank surfaces 60 defining abutments to prevent rotation.

I claim:

1. An electrical connector assembly having an anti-decoupling device, the assembly comprising: a pair of mateable connector shells adapted for mating along a primary axis and a coupling nut mounted for rotation on one of the shells for coupling the one shell to the other shell, said other shell including an annular shoulder the outer surface of which includes ratchet teeth spaced circumferentially therearound, and said anti-decoupling device comprising normally inoperative ratchet means engageable between said coupling nut and said other shell which become operative only when the connector shells approach their fully mated relation by rotation of the coupling nut in the mating direction, said ratchet means providing a lock against rotation of the coupling nut in the unmating direction and being manually releasable at any position where engaged without disturbing shell mating; and release means operative independently of said coupling nut rotation for releasing said ratchet means from engagement, said anti-decoupling device characterized by:

said release means comprising a latch member pivotally mounted to the coupling nut for flexure laterally of the axis and including at least one ratchet tooth for pivoting into and out of engagement with the ratchet teeth, and the outer circumference of said annular shoulder and the inner face of said latch member including said tooth define tapered and frusto-conical surfaces relative to the axis.

2. The electrical connector assembly according to claim 1, characterized in that:

said coupling nut is comprised of a plastic material and integrally formed into one piece.

3. The electrical connector assembly according to claim 1, wherein:

said latch member includes a forward end portion having an arcuate inner face extended forwardly of said coupling nut and adapted to be brought into register with said annular shoulder when the shells are nearly fully mated, the inner face including the ratchet tooth extending radially inward therefrom.

4. The electrical connector assembly according to claim 1 wherein said inner face includes a contiguous plurality of longitudinally extending ratchet teeth.

5. The electrical connector assembly according to claim 1, wherein:

said interengageable ratchet teeth and ratchet tooth comprise first and second flank surfaces with one respective flank surface of each being substantially radially extending to define cooperating abutments which deny contra-rotation.

6. The electrical connector assembly according to claim 1 wherein:

said interengageable ratchet teeth and ratchet tooth comprise first and second flank surfaces with each of the respective flank surfaces being acutely angled relative to a radius extending from the axis and being adapted to engage to impede rotation in either direction.

7. A self-locking anti-decoupling arrangement for retaining coupled connection between a pair of connector shells and a coupling nut mounted about one of the connector shells for rotational movement thereabout, comprising: a laterally deflectable latch member mounted to the outer periphery of said coupling nut, said latch member being axially extending, having a deflectable end extending forward of said coupling nut, and having an axially extending locking tooth projecting radially inward therefrom; an axially extending shoulder disposed annularly around said other connector shell, said shoulder defining a frusto-conical surface and including a contiguous succession of axially extending ratchet teeth therearound; and resilient means biasing said locking tooth towards said outer periphery, said locking tooth being adapted to axially slidably engage said ratchet teeth projecting from said shoulder only when the connector shells reach substantial full connection.

8. An anti-decoupling arrangement for retaining connection between a pair of connector shells, said arrangement including a coupling nut mounted about one connector shell for rotation thereabout and adapted to connect to the outer shell, the anti-decoupling arrangement comprising a latch member having a laterally deflectable end portion extending forwardly of the coupling nut, a plurality of longitudinal splines carried by the latch member in spaced relation about the forward end portion thereof, a contiguous plurality of longitudinal splines spaced angularly around a frusto-conical outer periphery of said other shell to slidably engage said splines on said latch member, and resilient means for biasing the forward end portion of the latch member radially inward toward a position said splines are engaging, the inner surface of said latch member being tapered and frusto-conical.

9. A self-locking coupling device for retaining connection between a pair of axially engageable multi-contact connector shells and including a coupling nut mounted about the engaging end of one shell for rotational movement thereabout for coupling engagement with the engaging end of the other shell to draw the shells together upon rotation of the coupling nut in one direction, whereby respective end faces on the coupling nut and other shell are abutting, characterized by a shoulder having a tapered frusto-conical surface extending around the other shell and adjacent the end face thereof, a resilient flexibly mounted locking beam positioned about said nut and having a forward end portion thereof extending forwardly of the end face thereof, ratchet means projecting radially inward and outward, respectively, from the inner surface of said beam and said outer surface of said shoulder, said beam being rotatable with the coupling nut and positioned thereabout, the ratchet means being axially slidable for engagement and normally non-engaging until the end face of the coupling nut approaches the other shell end face, and resilient means biasing the beam and the ratchet means together and toward the position said ratchet means are engaging.

* * * * *